United States Patent [19]

de Vrijer et al.

[11] 4,331,901

[45] May 25, 1982

[54] ELECTRIC INCANDESCENT LAMP

[75] Inventors: Bertus de Vrijer; Leonard C. H. Eijkelenboom; Jan de Ridder, all of Eindhoven, Netherlands

[73] Assignee: U.S. Philips Corporation, New York, N.Y.

[21] Appl. No.: 139,943

[22] Filed: Apr. 14, 1980

[30] Foreign Application Priority Data

Feb. 26, 1979 [NL] Netherlands ..... 7901482

[51] Int. Cl.[3] ..... H01J 1/42; H01K 9/08

[52] U.S. Cl. ..... 313/315; 313/112; 313/113

[58] Field of Search ..... 313/315, 112, 113, 114, 313/115, 117

[56] References Cited

U.S. PATENT DOCUMENTS

| | | | |
|---|---|---|---|
| 1,804,049 | 5/1931 | Claus | 313/115 |
| 3,038,372 | 6/1962 | Lessman | 313/114 X |
| 3,344,303 | 9/1967 | Prenger | 313/115 X |
| 4,041,344 | 8/1977 | LaGiusa | 313/113 |
| 4,227,113 | 10/1980 | Walsh | 313/112 |

*Primary Examiner*—Saxfield Chatmon, Jr.
*Attorney, Agent, or Firm*—Robert S. Smith

[57] ABSTRACT

In the electric incandescent lamps having an infrared radiation-reflecting filter which is pervious to visible light, the efficiency can be increased by adapting the geometry of the filter and the geometry of the filament to each other. According to the invention, the filter comprises a major portion of a prolate ellipsoid of revolution and a cylindrical filament extends between the foci thereof, the distance between focal points being from 1-2 times the length of the filament.

2 Claims, 1 Drawing Figure

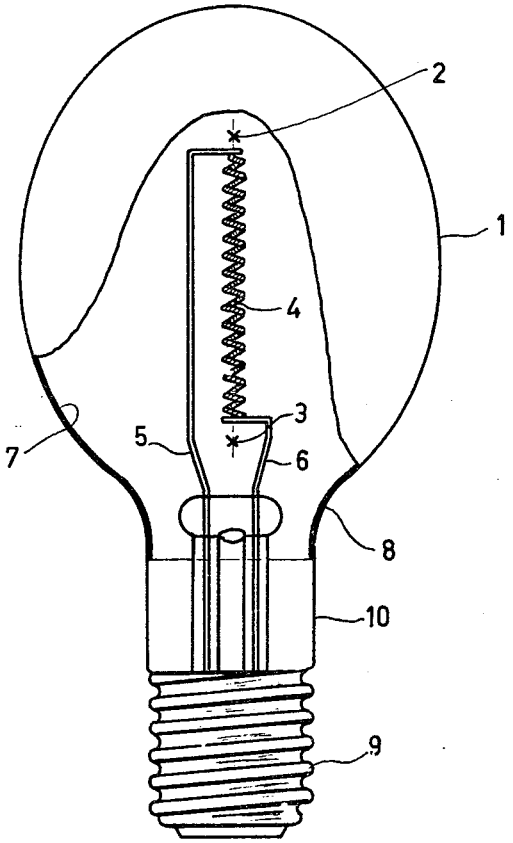
2
1
4
3
5
6
7
8
10
9

ELECTRIC INCANDESCENT LAMP

The invention relates to an electric incandescent lamp in which a filament is accommodated in a sealed vacuum-tight envelope which substantially has the shape of a prolate ellipsoid of revolution and the wall of which is coated with a visible-light-pervious, infrared-radiation-reflecting filter. Such a lamp is disclosed in German Offenlegungsschrift 2,811,037.

The object of the infrared (I.R) radiation-reflecting filter is to return the I.R. radiation emitted by the filament onto the filament and hence maintain its temperature level so that the electrical energy supplied to the lamp is used to a greater extent to generate visible radiation and the efficiency of the lamp is increased.

For optimum operation of a lamp it is necessary for the geometry of the filter and the geometry of the filament to be adapted to each other. Only with correct adaption is it achieved that the greater part of the I.R. rays fall back on the filament after having been reflected only once by the filter. This is of importance because filters which are pervious to visible radiation have a coefficient of reflection for radiation in the near infrared which is considerably less than unity. If several reflections were necessary to return I.R. radiation to the filament, the heat flow to the filament would be reduced according to the coefficient at every reflection. As a result of this the efficiency gain which can be achieved by using a filter would be lessened.

However, it is not sufficient to ensure that a large part if the emitted I.R. radiation returns to the filament. It is also necessary to achieve that the reflected I.R. radiation returned to the filament is substantially uniformly distributed over the surface thereof. If this condition is not satisfied, temperature difference occur between parts of the filament so that in the warmer parts a more rapid evaporation of the material of the filament occurs. This results in a higher electrical resistance and, hence, a further increase of the temperature. As a result of this the life of the lamp is considerably shortened.

Adapting the geometry of the filament to the geometry of the filter means that, in the case of a spherical filter, a punctiform filament would ideally have to be used. Since this is impossible one may recourse to a quasi-spherical filament which is as compact as possible for example of the type shown in FIG. 4 of the cited Offenlegungsschrift. However, in the case of line voltage lamps it is substantially impossible to support such a filament in such a manner that it maintains its shape. Moreover the diameter of the filter must be very much larger that the major dimensions of the space occupied by the filament.

It is the object of the invention to provide lamps of the kind mentioned in the opening paragraph in which a high improvement of the efficiency can be realized with a simple geometry of the filament.

In lamps of the kind mentioned in the opening paragraph this object is achieved in that the filament is a straight cylindrical body of helically wound wire which is accommodated with its cylindrical axis extending symmetrically between the foci of the ellipsoid of revolution, the distance between the focal points being 1 to 2 times the axial length of the cylindrical filament.

It has been found that this geometry and this dimension ratio is very favorable in incandescent lamps of the most frequently used type, that is to say line voltage general lighting service (GLS) lamps having a power up to 150 W, and gives a large efficiency improvement as compared with lamps without infrared radiation-reflecting filters. The lamps have the important advantage as compared with lamps having a quasi-spherical filament that the filament can very easily be manufactured and be accommodated in the desired shape in the lamp envelope.

A further advantage of the lamps is that this shape, differs only little from that of the currently used incandescent GLS lamps.

It is to be noted that it is stated in the cited German Offenlegungsschrift that when using a lamp vessel having the shape of an ellipsoid of revolution the filament has a shape which is necessary to obtain a radiation pattern which approaches the shape of the lamp envelope as much as possible. Apart from this generally vague description, the Offenlegungsschrift does not state anything as regards the shape of the filament, the ratios of the dimensions of filament and lamp envelope, and the positioning of the filament in the lamp envelope with which this object could be realized. It is therefore not only surprising that the object can be realized with a simple filament but, in addition, that the lamp according to the invention, as regards construction and geometry, is so much simpler than a lamp having a spherical lamp envelope and quasi-spherical filament which is described in detail in the the Offenlegungsschrift.

The length of the minor axis of the ellipse which by revolution around the major axis gives the ellipsoid of revolution is of little significance for the efficiency increase of the lamp. When choosing the width of the lamp envelope, one may therefore be primarily led by considerations of an economic, manufacturing and aesthetic nature. Generally, the length of the minor axis will be less than 5 times the filament length.

In practice lamps according to the invention have a lamp envelope having a necked portion coaxially with the major axis of the ellipse adjoining the prolate ellipsoid of revolution. Said portion gives the filament access to the space enclosed by the ellipsoid of revolution in lamp manufacturing and allows for the vacuum tight sealing of the lamp envelope. The ellipsoid of revolution thus is deficient to a small extent as a result of the presence of the necked portion. It was found that for optimum efficiency of the lamp and distribution of I.R. radiation over the filament the distance between the focal points is from 1.2 to 1.4 times the length of the cylindrical filament.

It is advantageous to make the diameter of the filament helix as large as possible, since the assembly tolerance of the filament perpendicular to its axis is approximately half the diameter of the filament, however in order to have a filament of sufficient rigidity its length should be at least five times its diameter. It is furthermore advantageous to make the filament as optically dense as possible so that infrared radiation which is reflected towards the filament will impinge on the filament and not pass between the turns of the filament to the wall of the envelope. Winding parameters of the filament are preferably chosen to be such that less than 50% of the reflected I.R. rays can pass through the filament.

For the light-pervious, I.R. radiation-reflecting filter, materials of a variety of natures may be used. For example, an interference filter may be used, whether or not in combination with a metal oxide filter doped with metal atoms, for example as described in U.S. Pat. No. 4,017,758. A filter as described in the above-mentioned German Offenlegungsschrift, or in the corresponding U.S. Pat. No. 4,160,929, which is incorporated herein by reference, may alternatively be used. Such a filter consists, for example, of a layer of silver between two layers of $TiO_2$. Filters of this kind are also described in literature, for example, in Applied Physics Letters, Vol. 25, No. 12, 693–695 (1974).

They can be manufactured by means of the usual methods, for example, vapor deposition, dipping, or spraying. If desired, the lamp envelope may be constructed from two parts, each having the form of half an ellipsoid formed by revolution of an ellips around its major axis.

An elevation, partly broken away, of an embodiment of a lamp according to the invention is shown in the accompanying drawing, in which, reference numeral 1 denotes a lamp envelope formed mainly as an ellipsoid of revolution. The lamp envelope loses its ellipsoidal shape near the curved region 8 where the lamp envelope obtains the usual tube shape 10 so as to enable assembly thereon of a lamp cap 9. The foci of the ellipsoid of revolution are denoted by 2 and 3. A helical (coiled-coil) filament 4 is stretched between pole wires 5 and 6 so as to be substantially coaxial with the lamp envelope. The distance between the focal points is from 1 to 2 times the axial length of the filament, preferably from 1.2 to 1.4 times. A light-pervious, infrared radiation-reflecting filter 7 is provided on the wall of the lamp envelope.

EXAMPLES (1a) A lamp envelope having the form of a prolate ellipsoid of revolution had a distance between the focal points of 21 mm. The largest diameter at right angles to the major axis of the ellipse was 60 mm. A straight cylindrical filament consisting of coiled coil tungsten wire was extended symmetrically between the foci in the lamp envelope. The filament had a length of 17 mm and an outside diameter of 1 mm.

Coaxially with the major axis of the ellipse, a necked lamp envelope portion joined the ellipsoid of revolution and had a diameter of 30 mm and was provided with a lamp cap.

The lamp vessel was provided on its inner surface with a $TiO_2$ layer of 18 nm, on which first a silver layer of 18 nm and then a $TiO_2$ layer of 18 nm had been provided. The lamp consumed a power of 55 W at 120 V and gave 1375 lumens.

(1b) A similar lamp without a light-pervious, infrared radiation-reflecting filter gave 1500 lumens with a consumed power of 100 W at the same filament temperature.

(1c) For further comparison a lamp having a cylindrical lamp envelope, inside diameter 34 mm, was provided with the same type of filter. The filament was accommodated coaxially with the lamp envelope. The lamp consumed a power of 94 W at 120 V and gave 1375 lumens.

(2) The relation between the length of the filament and the distance between the focal points of the ellipsoid of revolution is shown in the following table.

| filament length x (mm) | distance between focal points y (mm) | y/x | consumed power (W) |
|---|---|---|---|
| 17 | 17 | 1 | 57 |
| 17 | 21 | 1.24 | 55 |
| 17 | 24 | 1.41 | 55 |
| 17 | 28 | 1.65 | 56 |

Luminous output in each event 1375 lumens.

What is claimed is:

1. An electric incandescent lamp in which a filament is accommodated in a sealed vacuum-tight lamp envelope which substantially has the shape of a prolate ellipsoid of revolution and the wall of which is coated with a visible-light pervious, infrared-radiation-reflecting filter, characterized in that the filament is a straight cylindrical body of helically-wound wire which is accommodated with its axis extending between the foci of the ellipsoid of revolution and said body is symmetrically disposed with respect to said foci, the distance between focal points being 1 to 2 times the axial length of the cylindrical filament.

2. An electric incandescent lamp as claimed in claim 1, characterized in that the distance between focal points is from 1.2 to 1.4 times the length of the cylindrical filament.

* * * * *